United States Patent [19]

Grimes

[11] Patent Number: 4,815,154

[45] Date of Patent: Mar. 28, 1989

[54] BEACH PILLOW

[76] Inventor: Joseph E. Grimes, 1955 NE. 4th St., Deerfield Beach, Fla. 33441

[21] Appl. No.: 158,746

[22] Filed: Feb. 22, 1988

[51] Int. Cl.[4] ..... A47C 20/02

[52] U.S. Cl. ..... 5/441; 5/490

[58] Field of Search ..... 5/434–442, 5/417–420, 490; 297/397

[56] References Cited

U.S. PATENT DOCUMENTS

| | | | |
|---|---|---|---|
| 247,823 | 10/1881 | Hiller | 5/437 X |
| 1,300,480 | 7/1921 | Jennings | 5/490 |
| 2,792,576 | 5/1957 | Coady | 5/441 X |
| 3,204,678 | 9/1965 | Worcester | 5/441 X |
| 4,227,270 | 10/1980 | Rivera | 5/434 X |
| 4,383,713 | 5/1983 | Roston | 297/397 X |
| 4,654,906 | 4/1987 | Roberts | 5/417 |
| 4,688,286 | 8/1987 | Miker, Jr. | 5/490 |

*Primary Examiner*—Gary L. Smith
*Assistant Examiner*—Michael F. Trettel
*Attorney, Agent, or Firm*—John H. Faro

[57] ABSTRACT

An inflatable pillow usable outdoors and capable of resisting displacement by the wind or other force. The pillow has a pocket that may be filled with sand to weigh it down. The pillow also has an attached flap to keep the sand positioned in the pocket after the pillow is inflated. The pillow also has a pair of straps that can detachably fasten to the flap or pillow and form two loops, which loops can be used to attach the pillow to a beach or lawn chair.

6 Claims, 1 Drawing Sheet

BEACH PILLOW

BACKGROUND OF THE INVENTION

1. Field of the Invention

This invention relates to a beach pillow and particularly to an inflatable pillow that can resist being blown away or being displaced when used outdoors on a sandy beach. The pillow may also be attached to a beach chair if desired.

2. Description of the Prior Art

Many patents have issued disclosing novel combinations of pillows, towels and mats for recreational use on a sandy beach. Examples of such patents are U.S. Pat. Nos. 4,097,944 to E. N. Yulish; 4,195,378 to J. J. Parker; 4,231,125 to J. F. Tittl; 4,466,516 to R. Sicoli et al; 4,535,878 to N. S. Grahl; 4,546,507 to E. Weinstein; and patents cited therein. Some of the novel combinations include an inflatable pillow. When such a pillow is inflated, it is light in weight and easily displaced when the wind blows on it, or when it is leaned upon by the user.

To overcome this problem, some means are provided to prevent displacement. For example, the combination described in the Tittl patent cited above includes a special beach towel that folds over the pillow and attaches to itself. The combination described in the Weinstein patent provides a special beach towel, a pillow cover that encloses the inflated pillow and stakes to affix the towel and pillow cover to the beach.

OBJECTS OF THE INVENTION

An object of this invention is to provide a novel article of manufacture for use outdoors, particularly on a sandy beach.

Another object is to provide an inflatable beach pillow which contains within itself means to resist its displacement by wind or weight when it is in use.

A further object is to provide a pillow of the type just described that is light in weight and can be packed in a small volume.

Still another object is to provide a pillow of the type just described that includes means for removably attaching the novel pillow to a lawn chair or the like.

SUMMARY OF THE INVENTION

The novel article of manufacture comprises an inflatable pillow that has a pocket attached thereto which may be filled with sand to weigh down the pillow when it is in use. A flap is attached to the pillow along its proximal margin and is detachably fastened to the pillow along its distal margin to keep the sand positioned within the pocket. A pair of straps extend from a margin of the pillow and can detachably fasten to the flap or pillow and form two loops. The loops can be used to attach the pillow to a lawn chair or the like.

The novel article can be folded together and/or rolled up for storage ready for use. The pocket and flaps may be used for carrying personal items to the beach.

In one mode of use, the pocket is emptied of items and then is partially filled with sand, the flap is fastened to the pillow, the pillow is inflated as desired, whereby the pillow may be placed on any outdoor surface with the pocket side down. The pillow is able to resist displacement by wind or other force due to the weight of the sand in the pocket.

In another mode of use, the pillow is inflated, the pocket is left empty and the straps are placed around the frame of a beach or lawn chair and fastened to the pillow to form a backrest or a seat cushion.

When use has ended, the pocket is emptied of its contents and the pillow reassembled to a compact, small, light-weight package or carrier.

DETAILED DESCRIPTION OF THE INVENTION INCLUDING THE PREFERRED EMBODIMENTS

Figure 1:
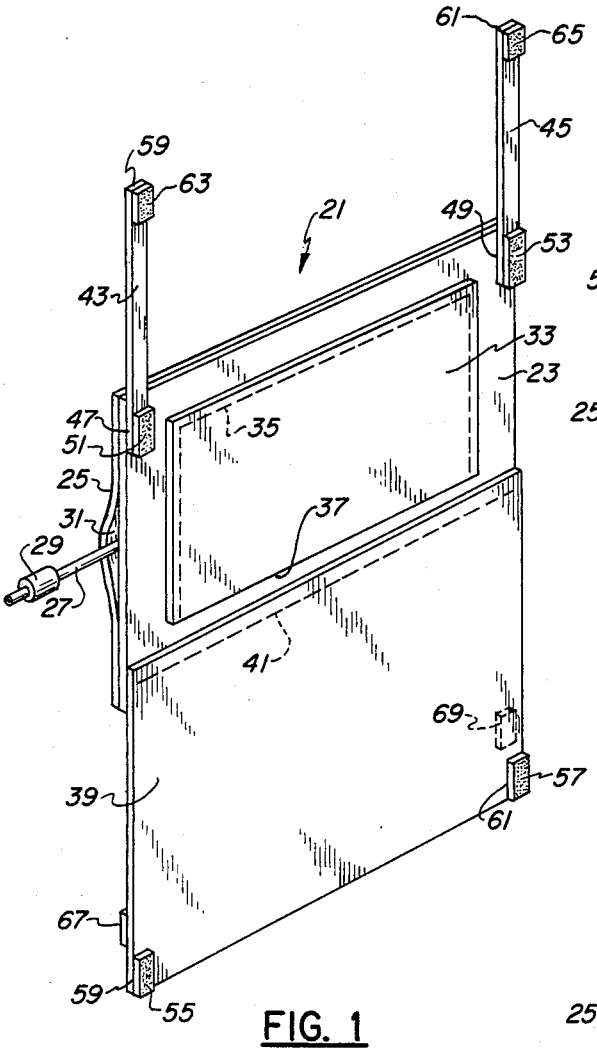
FIG. 1 is a perspective view of a preferred embodiment of the novel article of manufacture uninflated and extended flat.

The following description of some of the preferred embodiments of the concepts of this invention is made in reference to the accompanying figures. Where an individual structural element is depicted in more than one figure, it is assigned a common reference numeral for simplification of identification and understanding. The preferred embodiment of the novel article shown in FIG. 1 comprises a non-inflated rectangular inflatable pillow (21) including two rectangular panels (23) and (25) joined together along their margins. There is a means for inflating and deflating the pillow (21) including a tube (27) and a manual valve (29) for holding air in the pillow (21) when it is inflated and also to deflate an inflated pillow. The pillow (21) is made of a material; such as a flexible plastic, or rubber, or rubberized cloth, that will hold air pressure. The joint between the panels (21) and (23) is also air-tight. The pillow (21) includes a nest (31) adjacent to the tube (27) for storing the tube (27) and valve (29) when they are not in use.

A rectangular pocket (33) is attached as indicated by the first dash line (35) to a panel (23) of the pillow (21) along three of its sides as by heat-sealing or with an adhesive. The fourth side (37) of the pocket (33) is open and is adjacent one of the long margins of the pillow (21). The pocket (33) may be made of cloth or plastic or rubberized or plasticized fabric, and is smaller than the panel (23) to which it is attached.

A rectangular flap (39) is attached as indicated by the second dash line (41) to the pillow (21) along the one margin of the pillow (21) as by heat-sealing or with an adhesive. As shown, the flap (39) is substantially coextensive with the panel (23) and is attached in a position closely spaced from the open fourth side (37) of the pocket (33). The flap (39) may be made of the same or a different material as the pillow (21) or the pocket (33).

A pair of straps (43) and (45) are attached at their proximal ends (47) and (49) respectively to each of the corners of the other of the long margins of the panel (23) of the pillow (21) as by heat-sealing or with an adhesive. The straps (43) and (45) may be made of the same or a different material as the pillow (21) or the pocket (33).

The proximal ends (47) and (49) of the straps (43) and (45) respectively each carry the first male fastener elements (51) and (53) respectively of a mating first pair of fasteners. The corresponding first female fastener elements (55) and (57) respectively are attached to the corners (59) and (61) of the distal end of the flap (39). The flap (39) may be laid over the pocket (33) and fastened to the pillow (21) by mating the elements of the first fastener pairs (55) to (51) and (57) to (53).

The distal ends (59) and (61) of the straps (43) and (45) respectively each carry the second female fastener elements (63) and (65) respectively of a mating second pair of fasteners. All of the fastener element thus far described are attached to the pocket-side or front side of the article. The corresponding second male fastener elements (67) and (69) are attached to the opposite or back side of the flap (39) along the side margin thereof offset from the first female fastener elements (55) and (57) respectively. When the flap (39) is fastened to the pillow (21), the second fastener elements can be mated, (63) to (67) and (65) to (69) to form the straps (43) and (45) into loops.

Figure 2:
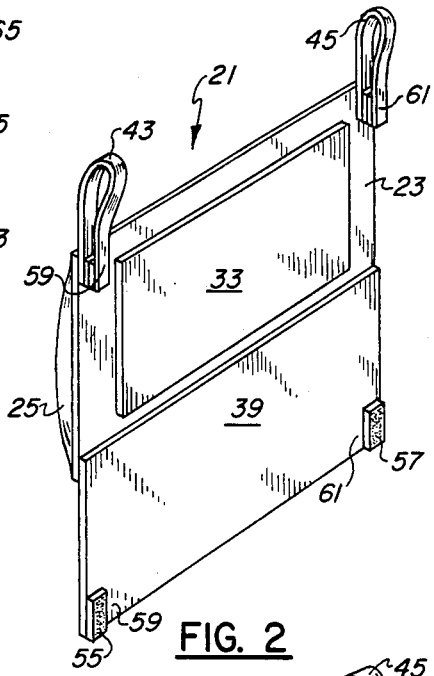
FIG. 2 is a perspective view of the embodiment shown in FIG. 1, inflated, with straps thereof formed into loops and the flap extended.

FIG. 2 shows the preferred embodiment with the pillow (21) inflated and the second female fastener elements (63) and (65) mated to the first male fastener elements (51) and (53) forming first and second loops with the straps (43) and (45) respectively. Prior to mating these fastener elements, the straps (43) and (45) can be positioned around the posts or other structure of a beach or lawn chair (not shown) and, after mating the fastener elements, the novel article can be used as a backrest or a seat cushion with the flap (39) extended.

Figure 3:
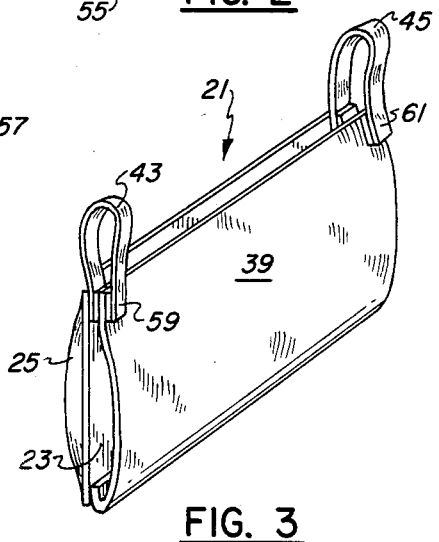
FIG. 3 is a perspective view of the embodiment shown in FIG. 1, inflated with the flap folded and the straps formed into loops.

FIG. 3 shows the preferred embodiment with the pillow inflated and the flap (39) fastened to the pillow (21) with the first fastener pairs, (55) to (51) and (57) to (53). The second fastener pairs are also mated, (63) to (67) and (65) to (69) to form the straps (43) and (45) respectively into first and second loops. Prior to mating the second fastener elements, the straps (43) and (45) can be positioned around the posts or other structure of a beach or lawn chair (not shown) and, after mating the second fastener elements, the novel article can be used as a backrest or a seat cushion with the flap (39) fastened.

Figure 4:
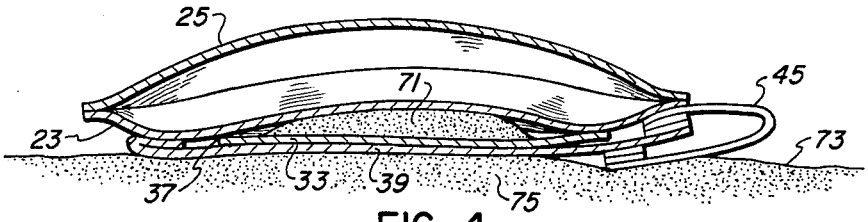
FIG. 4 is a sectional view of the embodiment shown in FIG. 1, partially filled with sand, inflated with the flap thereof folded and the straps formed into loops.

The sectional view shown in FIG. 4 shows the preferred embodiment of the novel article inflated and fastened as in FIG. 3 except that, prior to fastening the flap (39) to the pillow (21), the pocket (33) was partially filled manually with sand (71). The embodiment is shown lying on the surface (73) of a sand beach (75) with the pocket side of the pillow facing down. The sand (71) in the pocket (33), held in position by the fastened flap (39), weights the pillow so that it resists being displaced by the wind or other force. Thus, the novel article may be used as a convenient beach pillow on a beach surface or any other surface. When such use is ended, the novel article can be unfastened and the sand (71) can be removed manually through the open end (37) of the pocket (33).

The novel article can be made in any size. A preferred size is about 30.5 cm by 45.7 cm (about 12 inches by 18 inches). The novel article may be used in other places than a sand beach. It has been found that with the sand (71) in the pocket (33), as shown in FIG. 4, the pillow can be shaped more easily by the user and that the user does not have to inflate the pillow so much. Any convenient type of mating fasteners can be used, such as metal snap fasteners. The preferred fasteners are loop-and-pile fasteners, which are marketed under the tradename Velcro and are described in the above-cited Tittl patent. If desired the male and female fastener positions can be reversed.

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. An article of manufacture for use on a beach comprising an inflatable rectangular pillow, a rectangular pocket attached to said pillow and having its open side adjacent one of the long margins of said pillow, a rectangular flap attached to said pillow along said one long margin of said pillow, a pair of straps attached at spaced positions to the other of the long margins of said pillow, means for fastening the distal margin of said flap to said other margin of said pillow, and means for fastening the distal ends of said straps to said flap when the distal margin of said flap is attached to said other margin of said pillow.

2. The article defined in claim 1, wherein said flap is substantially coextensive with said pillow.

3. The article defined in claim 2, wherein said pocket is adapted to be filled with sand and can be emptied of said sand.

4. The article defined in claim 3, wherein said flap retains said sand in said pocket when said distal margin of said flap is fastened to said pillow.

5. The article defined in claim 4, wherein said fastening means are loop-and-pile fasteners.

6. An article of manufacture for use on a beach comprising an inflatable rectangular pillow, a rectangular pocket attached on three sides to said pillow and having its open fourth side adjacent one of the long margins of said pillow, said pocket being adapted to be filled with sand from said beach and being emptied of said sand, a rectangular flap attached along said one long margin of said pillow, said flap being substantially coextensive with the rectangular surface of said pillow, a pair of straps attached to each of the corners of the other of the long margins of said pillow, means for detachably fastening the distal corners of said flap to the corners of said other margin of said pillow, and means for detachably fastening the distal ends of said straps to said flap when the distal corners of said flap are attached to the corners of said other margin of said pillow, said straps forming attachment loops when the distal ends thereof are attached to said pillow.

* * * * *